US008914999B2

(12) United States Patent
DeLise, Jr.

(10) Patent No.: US 8,914,999 B2
(45) Date of Patent: Dec. 23, 2014

(54) EXTENDED CONTENT LABEL WITH NARROW OVERLAMINATE

(75) Inventor: Stephen W. DeLise, Jr., West Islip, NY (US)

(73) Assignee: MiniGraphics, Inc., Hauppauge, NY (US)

( * ) Notice: Subject to any disclaimer, the term of this patent is extended or adjusted under 35 U.S.C. 154(b) by 197 days.

(21) Appl. No.: 13/600,533

(22) Filed: Aug. 31, 2012

(65) Prior Publication Data

US 2014/0059906 A1 Mar. 6, 2014

(51) Int. Cl.
*G09F 3/00* (2006.01)

(52) U.S. Cl.
USPC ..... 40/310; 40/638

(58) Field of Classification Search
CPC ..... G09F 3/0289; G09F 3/10
USPC ..... 40/638, 310
See application file for complete search history.

(56) References Cited

U.S. PATENT DOCUMENTS

| | | | | |
|---|---|---|---|---|
| 5,234,735 | A * | 8/1993 | Baker et al. | 428/41.7 |
| RE34,366 | E * | 9/1993 | Instance | 40/638 |
| 5,324,559 | A | 6/1994 | Brombacher | |
| 5,685,530 | A | 11/1997 | DeLise | |
| 5,813,700 | A | 9/1998 | Vijuk et al. | |
| 5,830,550 | A | 11/1998 | Treleaven et al. | |
| 6,179,335 | B1 | 1/2001 | DeLise, Jr. | |
| 6,213,520 | B1 | 4/2001 | Treleaven et al. | |
| 6,329,034 | B1 * | 12/2001 | Pendry et al. | 428/40.1 |
| 6,432,499 | B1 | 8/2002 | Roth et al. | |
| 6,432,500 | B1 | 8/2002 | Jones et al. | |
| 6,439,614 | B1 | 8/2002 | Cowan | |
| 6,576,315 | B2 | 6/2003 | Treleaven et al. | |
| 6,712,398 | B1 | 3/2004 | Fox et al. | |
| 6,737,137 | B2 | 5/2004 | Franko, Sr. et al. | |
| 6,948,743 | B1 | 9/2005 | Peterson | |
| 7,947,351 | B1 | 5/2011 | Cowan | |
| 8,003,183 | B1 * | 8/2011 | Cowan | 428/40.1 |
| 2002/0122910 | A1 * | 9/2002 | Grosskopf et al. | 428/40.1 |
| 2004/0033876 | A1 * | 2/2004 | Vijuk et al. | 493/405 |

(Continued)

FOREIGN PATENT DOCUMENTS

| | | |
|---|---|---|
| GB | 2303351 | 2/1997 |

OTHER PUBLICATIONS

International Search Report and Written Opinion from International Stage Application No. PCT/US2013/070939 mailed Apr. 4, 2014.

(Continued)

*Primary Examiner* — Gary Hoge
(74) *Attorney, Agent, or Firm* — Keusey & Associates, P.C.

(57) ABSTRACT

An extended content label with a narrow overlaminate having a substrate, a leaflet and an overlaminate strip. The leaflet is adhered to a section of the upper surface of the substrate and has several overlying panels, longitudinally-extended accordion-type folds alternating along a top and bottom of each panel, and a perpendicular fold oriented normal to the longitudinal direction. The leaflet is a single sheet that is folded into a leaflet without the use of glue. The overlaminate strip is laminated across the entire longitudinal direction of the leaflet and laminated to another section of the upper surface of said substrate to form an extended content label. The height of the overlaminate strip is narrower than the leaflet so that all of the accordion-type folds extend beyond the overlaminate strip.

21 Claims, 6 Drawing Sheets

(56) References Cited

U.S. PATENT DOCUMENTS

| | | | | |
|---|---|---|---|---|
| 2004/0041392 | A1* | 3/2004 | Seidl | 283/81 |
| 2008/0003410 | A1* | 1/2008 | Shacklett et al. | 428/189 |
| 2011/0223368 | A1 | 9/2011 | Zietlow et al. | |

OTHER PUBLICATIONS

International Search Report and Written Opinion from Int'l. Stage PCT Application No. PCT/US2013/070951 dated Apr. 25, 2014.

* cited by examiner

EXTENDED CONTENT LABEL WITH NARROW OVERLAMINATE

BACKGROUND OF THE INVENTION

1. Field of the Invention

The invention relates to an extended content label (ECL) with a narrow overlaminate.

2. The Prior Art

Frequently product containers are identified by applying an adhesive-backed label to an outer surface of the container. Such labels retain their product-identifying purpose by remaining permanently affixed to the container.

Certain products which require extensive instructions or which are subject to significant government regulations require additional printed matter which is typically inserted into the product container. In the case of pharmaceuticals, the printed matter may be in the form of printed sheets, printed inserts, or printed outserts. An example of such may be seen in U.S. Pat. No. 5,685,530. While these various forms of printed matter have the benefit of providing a relatively large amount of information, their overall effectiveness is limited if they become separated from the product container.

U.S. Pat. No. 5,830,550 entitled Booklets and Self Adhesive Labels Including the Same shows single labels and multi-up booklets adhered to a continuous web. A label product including a release liner having an upper surface and a booklet disposed on the upper surface of the release liner. The booklet includes an outer piece including a top panel and a bottom panel joined by an outer fold, an inner piece disposed between the top and bottom panels having a pair of interior panels joined by an inner fold, attaching means coupling the outer and inner pieces to one another at the outer and inner folds, and a tear line formed in the bottom panel adjacent the outer fold. A layer of adhesive is interposed between the bottom panel and the upper surface of the release liner. In certain embodiments a booklet is formed where the pages are attached together at the spine. Such booklets do not utilize accordion folded leaflets which can be made with fewer steps by eliminating internal gluing steps and external fold trimming steps. In addition, all embodiments employ a full height overlaminate which covers the entire booklet.

U.S. Pat. No. 6,576,315 entitled Multi-Ply Resealable Label shows booklets with windows adhered to a continuous web. A label includes a base label having upper and lower opposed surfaces and first and second opposed ends. A base adhesive coats the lower surface of the base label. A top panel overlies the upper surface of the base label and is joined to the base label adjacent the first end. The top panel has an upper surface. A tab having upper and lower opposed surfaces overlies the upper surface of the base label. An adhesive patch is interposed between the base label and the tab adjacent the second end. The adhesive patch secures the lower surface of the tab to the upper surface of the base label. A laminate cover overlies the top panel and the tab. A laminate adhesive secures the laminate cover to the upper surface of the top panel and releasably joins the laminate cover to the upper surface of the tab.

U.S. Pat. No. 6,432,500 entitled Label with Booklet shows a label with an overlaminate that extends beyond the label perimeter. A label with booklet comprises a liner material and a label having an upper and lower surface located on the liner. The label is secured to the liner by an adhesive layer on its lower surface such that the label can be peeled off the liner with the adhesive remaining on the lower surface of the label. A booklet is affixed to the upper surface of the label and comprises a plurality of stacked pages having edges including a top page and a bottom page, each of the pages being coextensive with each other and of smaller dimensions than the label. The booklet further comprises a cover member entirely covering the top page and extending beyond at least two opposing edges of the top page, the cover member having an upper non-adhesive surface, and a lower surface having an adhesive thereon by means of which the lower surface of the cover member is permanently adhered to the upper surface of the top page. The booklet is completely removable from the label by removing at least a portion of the cover member.

U.S. Pat. No. 6,432,499 entitled Nested Label shows a label with die cut windows applied to a release liner. A nested label includes a liner having a surface release, and a label removably bonded to the liner by an adhesive. The liner and label have respective die cuts spaced apart from each other at a skip in the liner release for obtaining different bond strengths between the label and liner on opposite sides of the label die cut.

U.S. Pat. No. 6,948,743 entitled Multilayer Label and Method of Making Same shows multi-page labels with staggered sheets to facilitate application to curved containers. A multiple layer label and a method of making the same are provided. Specifically, a label having a base layer for adhering to a container is provided wherein the label has an overcoat layer having an end that is removably adhered to the container. Moreover, the end that is removably adhered to the container is grasped by a user of the label and pulled, thereby removing the end of the overcoat layer from the container and swinging the layer away from the remainder of the label and exposing sublayers beneath the overcoat layer. The overcoat layer is adhered directly to the base layer, and at least portions of the sublayers. Each of the overcoat layer, sublayers, and the base layer may have indicia printed thereon for communicating information.

U.S. Pat. No. 6,179,335 entitled Product Label Bearing an Instructional Booklet shows a folded booklet adhered to a portion of a label. A two part identifying and instructional booklet having a label part and a booklet part. The front of the label has a small unvarnished region. The booklet is folded and glued closed with the free edges secured interiorly. An adhesive is printed onto the unvarnished region of the label and the folded booklet is adhered to the unvarnished region. The booklet has a tab portion to facilitate opening of the book during use. The tab portion faces the identifying portion of the label which extends longitudinally outwardly from the unvarnished region. The label may be placed onto a cylindrical container and bent in the longitudinal direction whereby the spine and folds of the booklet remain straight, flat and parallel to each other.

U.S. Pat. No. 6,439,614 entitled Nested Leaflet Label Structure shows a booklet adhered to a label. A nested leaflet label structure having an enhanced information carrying capacity. The nested leaflet label structure includes a base panel having a front face. A first leaflet is adjacent to the front face and comprises a first folded panel having a first fold extending substantially parallel to the first axis of the label structure. The first fold divides the first folded panel into a pair of first leaves each having inner and outer page faces. A second leaflet comprises a second folded panel having a second fold extending substantially parallel to the first axis of the label structure. The second fold divides the second folded panel into a pair of second leaves each having inner and outer page faces. A laminating layer overlies the base panel and the first leaflet. The second leaflet is nested in the first leaflet. An assembling adhesive adheres the second leaflet to the first leaflet.

Fold-out labels made from single sheets are shown in U.S. Pat. No. Re. 34,366 and U.S. Pat. No. 5,830,550. An example of a booklet which incorporates certain advantages of a label is disclosed in U.S. Pat. No. 5,324,559. The patent discloses a relatively simple booklet containing four sheets, i.e., eight pages. In all of these patents, the first page contains information which would otherwise be placed on the product label. The entire back page is adhered to the container leaving only the intermediate pages for instructional information. A further drawback of these patents lies in the fact that if their first page becomes detached from the booklet the product container would be unlabeled. U.S. Pat. No. 6,712,398 shows method for making removable inserts. U.S. Pat. No. 6,737,137 describes a method for manufacturing adhesive image transfer labels.

Accordingly, it would be desirable to provide an identifying and instructional document which combines the permanent nature of an adhesive label with the instructional capacity of a multi-page booklet.

SUMMARY OF THE INVENTION

It is therefore an object of the present invention to provide an Extended Content Label (ECL) with a large printing area that can be economically manufactured.

It is another object to provide an overlaminate which is narrower than the leaflet.

It is a further object to have leaflet folds that are free to conform to varying container radius.

These an other related objects according to the invention are achieved by an extended content label with a narrow overlaminate having a leaflet stacked between a substrate and an overlaminate. The substrate has an upper surface and a leaflet adhered to a section of said upper surface. The leaflet includes a plurality of overlying panels, longitudinally-extended accordion-type folds alternating along a top side and a bottom side of each panel, and a perpendicular fold oriented normal to the longitudinal direction. An overlaminate strip that is laminated across the entire longitudinal direction of the leaflet and laminated to another section of the upper surface of said substrate to form an extended content label, wherein the height of said overlaminate strip is narrower than the leaflet so that all of the accordion-type folds extend beyond the overlaminate strip.

The said leaflet consists of a single printed sheet that is devoid of glue in its interior. The perpendicular fold divides said leaflet into a rear portion which is disposed adjacent said label, and a front portion which is disposed adjacent said overlaminate strip. A first outer panel section of the rear portion is at least partially adhered to said facestock. A portion of one accordion-type fold adjacent said first outer panel section of the rear portion is constrained by adhesive whereby the remaining accordion-type folds are free to independently conform to various radii. A second outer panel section of the front portion is partially covered by said overlaminate strip.

An end panel of said overlying panels includes said first outer panel section and said second outer panel section. The overlaminate strip includes two positions: a closed position in which the leaflet is pressed flat against said label, and an open position in which the leaflet is unfolded along said perpendicular fold. The overlaminate strip pivots between said closed position and said open position along a hinge located adjacent and parallel to said perpendicular fold.

The leaflet includes free ends opposite said perpendicular fold, wherein in said closed position said overlaminate strip extends beyond said free ends to a location co-planar with an and of said label. In the open position the overlying panels are generally straight and flat allowing said leaflet to unfold and fold along said accordion-type folds. The leaflet includes at least one additional fold to further divide the leaflet into at least one interior portion that is disposed in between said rear portion and said front portion.

Alternatively, the overlaminate strip includes two positions: a closed position in which the leaflet is pressed flat against said label, and an open position in which the leaflet is unfolded along said perpendicular fold. The overlaminate strip pivots between said closed position and said open position along a hinge located adjacent and parallel to said perpendicular fold. In the open position said rear portion and said front portion are angularly spaced from each other allowing at least one interior portion to unfold so that the overlying panels are generally straight and flat allowing said leaflet to unfold and fold along said accordion-type folds.

The substrate comprises a facestock having a bottom surface coated with adhesive, and a release liner, where the adhesive temporarily secures the facestock to the release liner. The substrate includes a first edge and a second edge, wherein the perpendicular fold is disposed parallel to and spaced from the first edge. The said leaflet includes free ends opposite the perpendicular fold that are disposed parallel to and co-linear with the second edge of the substrate.

The ECL Label further includes a crush zone including of the longitudinally extending accordion type folds and at least about 5% of the leaflet area adjacent the longitudinally extending accordion type folds. All of said longitudinally extending accordion type folds within the crush zone remain free from being adhered to the substrate and the overlaminate strip. Each of said longitudinally extending accordion type folds within said crush zone has a degree of freedom for radius conformity independently of said substrate and said overlaminate. The longitudinally-extended accordion-type folds alternating along a top side and a bottom side of each panel provide an air vent for each adjacent pair of panels on the bottom side and top side respectively.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF THE PREFERRED EMBODIMENTS

Figure 1A:
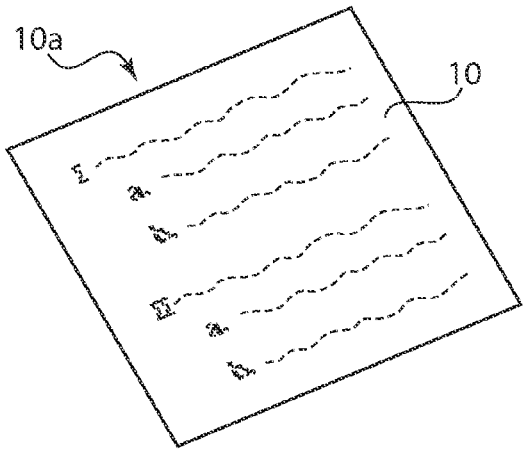
FIGS. 1A-1H are a series of views illustrating various embodiments of configuring flat sheets to form folded leaflets.
Figure 1B:
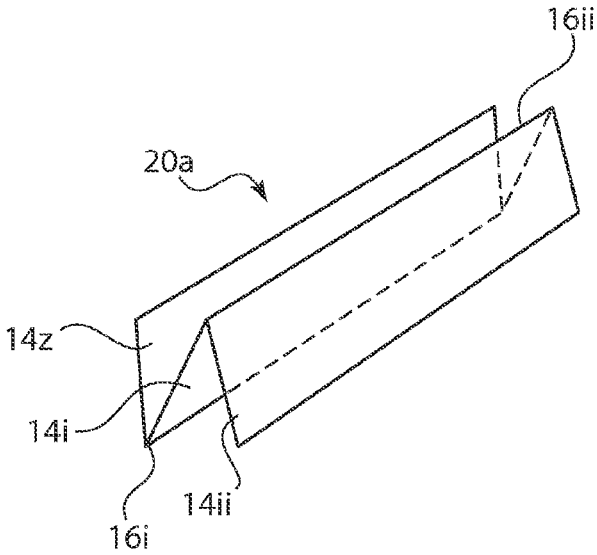
Figure 1C:
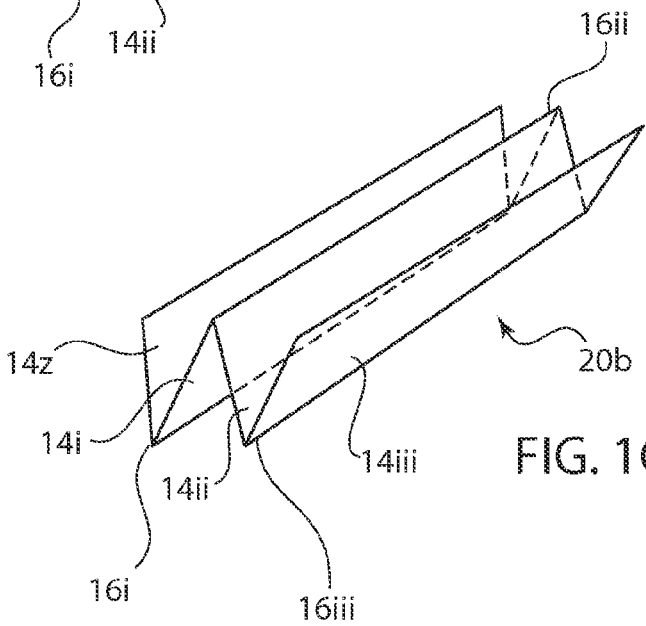
Figure 1D:
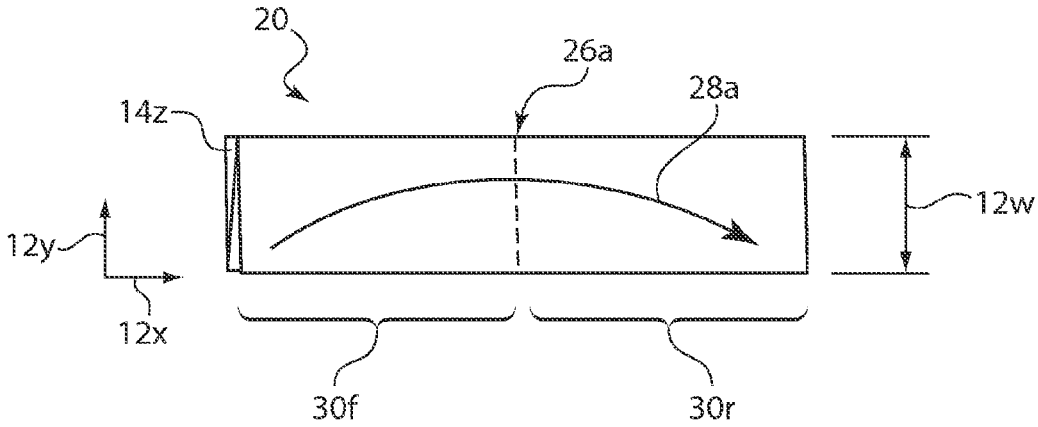

Referring now in detail to the drawings there is shown a folded leaflet that is adhered to a substrate and partially covered by an overlaminate to form an Extended Content Label (ECL). More particularly, FIG. 1A shows a sheet 10 that will be folded into various forms of an accordion-folded sheet as illustrated in FIGS. 1B, 1C and 1D. One or more perpendicular folds then produces the folded leaflet 30 as shown in FIG.

1E. The folded leaflet 30 is adhered to variously configured substrates 102 and 104 illustrated in FIGS. 2A and 2B, respectively. These substrates bearing folded leaflets are covered by a narrow overlaminate 500 to form ECL Labels shown in FIGS. 3A and 3B, respectively.

Since the overlaminate is narrower than the folded leaflet, the top and/or bottom of the perpendicular fold(s) and the corresponding top and/or bottom accordion-type folds extend beyond the overlaminate. As a result these outwardly extending folds are able to move independently of the overlaminate. Accordingly, when the ECL Label is rolled onto a cylindrical container, the free folds can be pressed flat.

FIG. 1A shows a sheet 10 containing printed information 10*a*. One sheet will form a single folded leaflet. Large sheets can be printed with two or more sets of information and then cut into individual sheets 10. The sheets can be printed on one or both sides. In a preferred embodiment, the indicia includes pharmaceutical information about drugs that are packaged with the booklets. The books can be printed by any suitable industrial printing process, for example sheet offset, web offset, flexographic, rotary letterpress, or gravure.

Sheet 10 is accordion folded two or more times to form three or more panels. FIG. 1B illustrates the smallest number of folds, e.g. two accordion-type folds 16*i* and 16*ii*. In this application, accordion-folded sheets are generally referred to as reference numeral 20. The accordion folded sheet 20*a* has three panels which include panels 14*i* and 14*ii* along with outer panel 14*z*. Additional panels extending from panel 14*ii* could be provided as 14*iii*, 14*iv*, 14*v* . . . 14*n*. It will be appreciated that for any number of panels n the number of folds will be n−1.

Adding one fold and one panel to the accordion folded sheet 20*a* of FIG. 1B results in the accordion folded sheet 20*b* of FIG. 1C. Starting from the back, an outer panel 14*z* is connected to panel 14*i* via accordion-type fold 16*i*, next panel 14*ii* is connected via accordion-type fold 16*ii*, lastly panel 14*iii* is connected via accordion-type fold 16*iii*.

Larger sheets 10 and an increasing number of accordion-type folds could produce accordion folded sheets with a plurality of panels. For example, buckle folders having 4, 6 or more plates could be used to produce a large number of accordion folded sheets in an efficient manner. In a buckle folder, sheet 10 enters the folder until it hits the first plate and buckles. The buckling section is gripped by rollers and creased to form a first fold. The sheet continues through the machine until it encounters the second plate and buckles again. A six plate buckle folder would produce six accordion-type folds and seven panels. Buckle folders with any number of plates could produce accordion-folded sheets for use in the invention. Other types of commercial or industrial folders could also be used.

Before or after the buckle folder, the sheet could have perforations formed along fold line 16*iii* to enable removal of the lower panels 14*iii*. Several sets of perforations could be formed at other fold lines or within the panels running parallel or perpendicular to the fold lines. As will be explained in further detail below, the outer panel 14*z* will be adhered to a substrate and an overlaminate. The lower panel 14*iii* then represents the free end, farthest from outer panel 14*z* when the leaflet is fully opened. If removable sections are to be provided, they would typically be removed from the free end, so that the other panels remain with the label and could be re-folded.

The leaflets are made from paper referred to as offset stock having a paper weight between 22# and 60#. The # designation is a measure of paper density measured in pounds per basis ream of 500 sheets of 17" by 22" paper. Such paper may be obtained from Twin Rivers Paper Company of South Portland, Me. or Finch Paper, LLC of Glen Falls, N.Y. For example Twin Rivers supplies 22# Custom Plus and 27#, 30#, 35#, 40# Pharmopaque—Regular Finish. Finch supplies 40# Finch Opaque—Wove Finish and 60# Finch Opaque—Vellum Finish. The preferred paper is Twin Rivers 27# Pharmopaque—Regular Finish.

Referring now to FIG. 1D, an accordion folded sheet 20 is shown in an elevational view. While three panels are shown for the sake of clarity, the accordion folded sheet 20 represents any sheet with 3 or more panels. Accordion folded sheet 20 has accordion-type folds extending in the longitudinal direction 12*x*. Perpendicular to direction 12*x* is the normal direction 12*y*. Accordion folded sheet 20 has a width 12*w* that is measured in the normal direction 12*y*. A perpendicular fold 26*a* is provided that runs in the normal direction 12*y*. Perpendicular fold 26*a* divides the accordion folded sheet 20 into a front portion 30*f* and a rear portion 30*r*. It will be appreciated that each portion contains panels 14*i*, 14*ii*, 14*iii*, etc and outer panel 14*z*. Front portion 30*f* and rear portion 30*r* are shown as being of approximately equal size. In other words, each portion is about one-half of the accordion folded sheets. The fold line could be shifted to produce unequal portions. In a two portion embodiment, having equal portions is preferred.

Figure 1E:
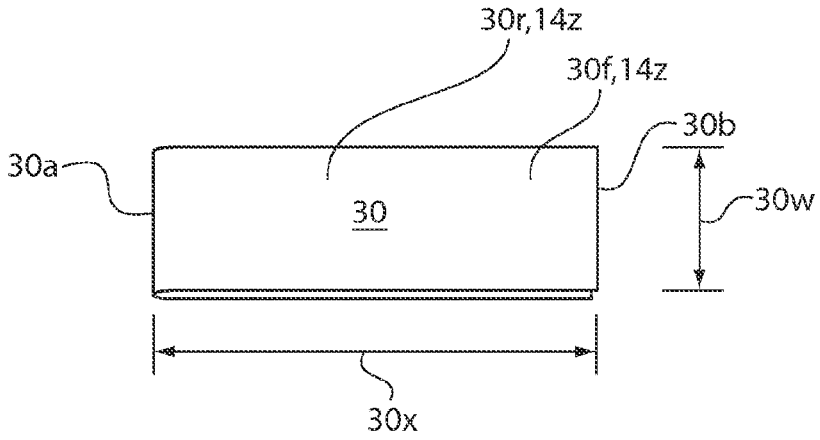

The front portion 30*f* is folded over the rear portion 30*r* according to the fold direction arrow 28*a*, resulting in a folded leaflet 30, as shown in FIG. 1E. The width 30*w* remains the same as width 12*w*. The length 30*x* is now one-half the length of the accordion folded sheet 20. The outer panel 14*z* wraps around the folded leaflet 30, with half of the outer panel residing within the rear portion 30*r* and the other half within the front portion 30*f*. The folded leaflet 30 also includes a folded end 30*a* and free ends 30*b*.

Figure 1F:
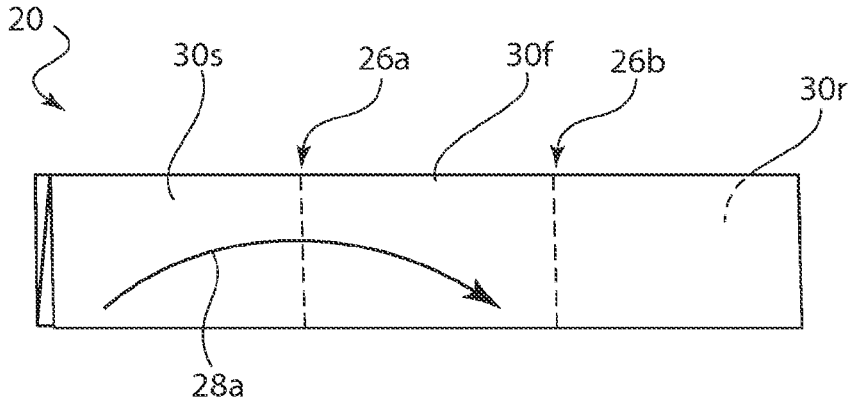
Figure 1G:
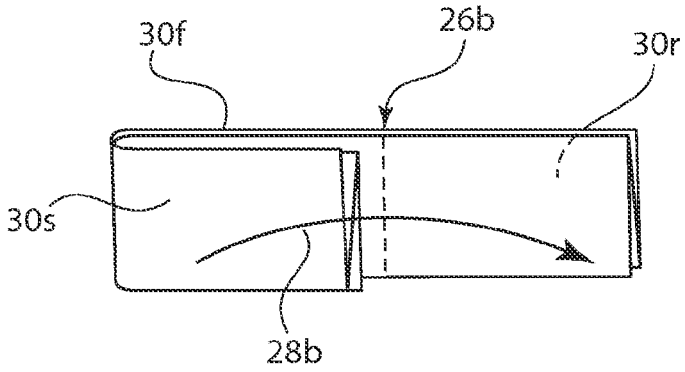
Figure 1H:
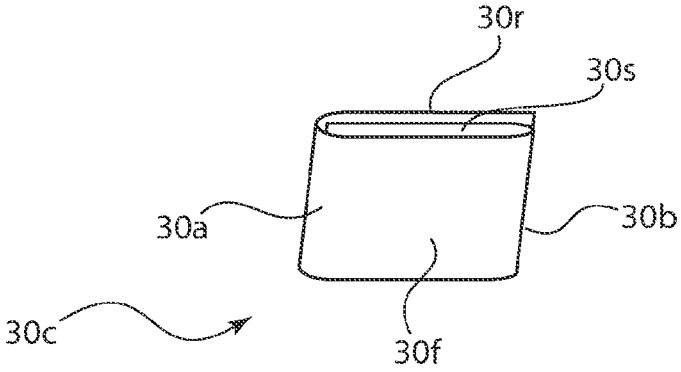

An alternate embodiment of a folded leaflet 30*c* is illustrated in FIGS. 1F, 1G and 1H. Starting with the same accordion folded sheet 20, two perpendicular folds 26*a* and 26*b* are provided to divide the accordion folded sheet 20 into thirds. The rear portion 30*r* and front portion 30*f* are supplemented with an additional portion 30*s*. The additional portion 30*s* is folded to overlie front portion 30*f* by folding in the direction of arrow 28*a* along perpendicular fold line 26*a*. The resulting configuration is shown in FIG. 1G. Next, the combined portion 30*s* and 30*f* are folded to overlie rear portion 30*f* by folding in the direction of arrow 28*b* along perpendicular fold line 26*b*. A folded leaflet 30*c* is produced as shown in FIG. 1H. The additional portion 30*s* is sandwiched between rear portion 30*r* and front portion 30*f*.

The fold lines could be shifted to produce unequal portions. In a three portion embodiment, having equal one-third portions is preferred. An end-over-end fold as illustrated in FIGS. 1G and 1H can be used to produce folded leaflets having four or more panels. Alternately, a four panel sheet could be folded in half, and then half again. Other folding arrangements may be used. The key feature is that the resulting folded leaflet has a rear portion 30*r* adjacent to one side of the folded end 30*a*, and a front portion 30*f* adjacent to the other side of folded end 30*a*. The front and rear portion coupled to folded end 30*a* forms a hinge which allows the folded leaflet to be opened as will be discussed in greater detail below. The one or more additional portions 30*s* could be arranged in various configurations.

Figure 2A:
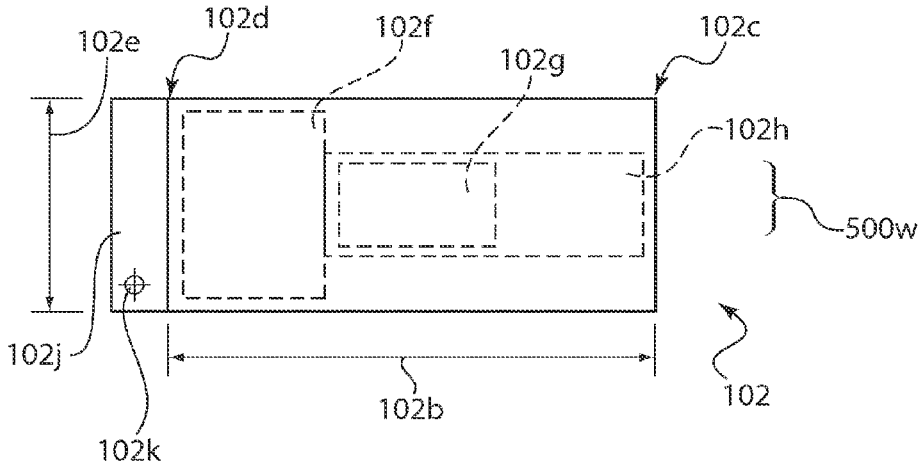
FIGS. 2A and 2B are a series of front side elevational views showing various embodiments of substrates.

The folded leaflet 30 or 30*c* is adhered to a substrate 102 shown in FIG. 2A. Dimensionally, the substrate 102 includes a length 102*b*, a leading edge 102*c*, a trailing edge 102*d* and a width 102*e*. Structurally, the substrate 102 includes a text section 102*f*, an adhesive section 102*g*, a leaflet section 102*h*, a waste panel 102*j* and a registration mark 102*k*. Adhesive can be sprayed or printed onto adhesive section 102*g* to adhere a folded leaflet 30, which will overlie the adhesive section 102*h*. Note that adhesive section 102*g* comprises an area smaller than leaflet section 102*h*. Leaflet section 102*h* is the exact footprint of folded leaflet.

Adhesive section 102*g* is 60 to 99% of the height of leaflet section 102*h*. In an alternate embodiment, adhesive section 102*g* is 25 to 75% of the length of leaflet section 102*h*. In a further embodiment, adhesive section 102*g* is 10 to 90% of the area of leaflet section 102*h*.

To the left of leaflet section 102*h*, there is a text section 102*f* which will remain visible after the folded leaflet is disposed onto substrate 102. Accordingly, text, bar codes, brands or other indicia may be printed in this text section 102*f*. Indicia may also be printed in the areas above and below leaflet section 102*h*. Further to the left is a waste panel 102*j*, bearing a registration mark 102*k*. The ECL labels according to the invention may be manufactured by dispensing folded leaflets 30, one at a time onto a continuous web of label stock which has a series of first substrates 102 along its length. In such a manufacturing process, registration mark 102*k* is read by a scanner to: print text in registration with text section 102*f*; print adhesive in registration with adhesive section 102*g*; and dispense a folded leaflet 30 in registration with leaflet section 102*h*. Thereafter, waste panel 102*j* is die cut and removed from the web, leaving the release liner to carry the series of labels. Removal of waste panel 102*j* creates a small space between competed ECL Labels to facilitate peeling of individual ECL Labels without disturbing the downstream ECL Label.

Suitable labels include those having between 54# to 50# facestock. Such label stock is available from Avery Dennison sold under the trademame Fasson®. For example, Avery Dennison supplies 54# semi-gloss facestock (paper) coated with C2500 rubber based adhesive disposed on 40# bleached, calendered kraft stock liner; and 60# semi-gloss facestock (paper) coated with S246 general purpose permanent rubber based adhesive FDA compliant with 21 CFR 175.105 disposed on 40# bleached, calendered kraft stock liner. The preferred label stock is the latter 60# semi-gloss facestock coated with S246 disposed on 40# stock.

Four components are combined to form a completed Extended Content Label (ECL) label 100. From the bottom up the four components are: (1) the substrate 102; (2) adhesive 400 applied within adhesive section 102*g*; (3) folded leaflet 30, 300; and (4) overlaminate 500.

Glue used to secure the books to the web may be selected from various adhesives used in paper converting applications that are approved for use in pharmaceutical packaging. Such adhesive may be permanent acrylic adhesive, for example, clear, permanent acrylic adhesive S8020 available from Avery Dennison sold under the tradename Fasson®.

Figure 3A:
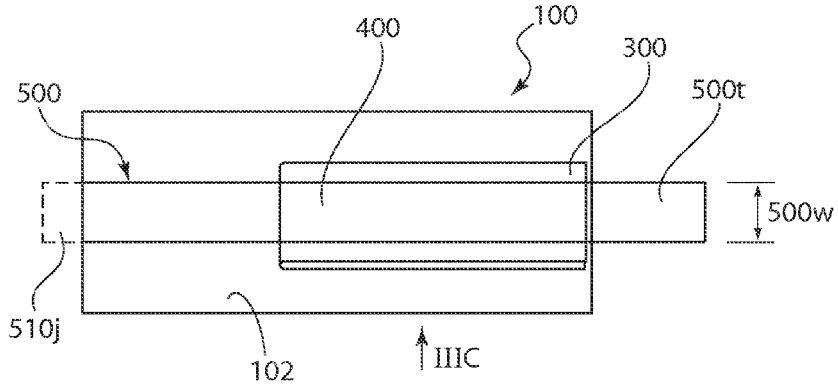
FIGS. 3A and 3B show a series of elevational views illustrating various embodiments of ECL Labels.
Figure 3B:
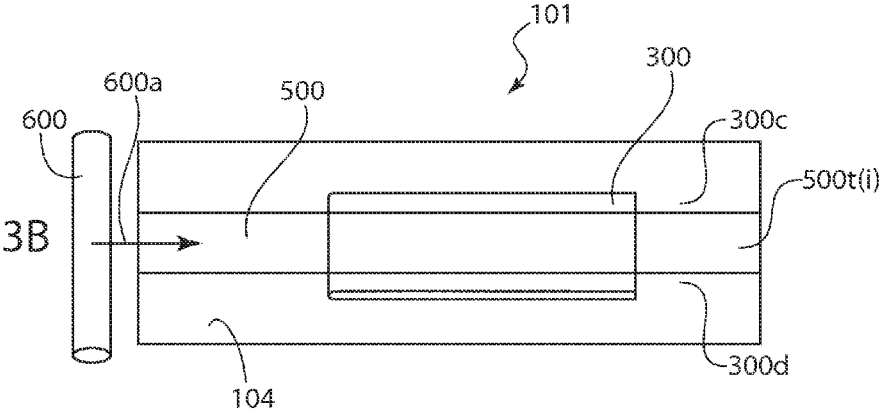

As can be seen in FIG. 3A, overlaminate 500 includes an overlaminate tab 500*t* which extends beyond leading edge 102*c* (which is co-linear with free ends 30*b*) and folded leaflet 300. Overlaminate tab 500*t* is temporarily adhered to the release liner in the gap between sections of facestock which has been created by removal of waste panel 102*j*. Overlaminate 500 is applied as a second continuous web. A second die cut station will then cut and remove a small section of waste overlaminate 500*j* to physically separate the ECL Labels from each other.

Suitable laminate includes facestock between 0.8 to 1 mil thick coated with adhesive disposed on a liner. Suitable laminates are available from Avery Dennison sold under the tradename Fasson®. For example, Avery Dennison supplies 0.8 mil polypropylene facestock coated with clear, permanent acrylic adhesive; and 1 mil clear printed—treated polyester coated with S8020 clear, permanent acrylic adhesive disposed on 40# bleached white glassine liner. The preferred laminate is the latter 1 mil clear printed—treated polyester coated with S8020 clear, permanent acrylic adhesive disposed on 40# bleached white glassine liner.

Overlaminate 500 has an overlaminate width 500*w* that is narrower than the width 12*w* of folded leaflet 30, 300. As a result a portion of folded leaflet 300 is free from overlaminate in the vicinity of the top and or bottom accordion type folds 16. In addition, a top and/or bottom portion of folded ends 30*b* are free from overlaminate. Since the overlaminate is narrower than the folded leaflet, the top and/or bottom of the perpendicular fold(s) and the corresponding top and/or bottom accordion-type folds extend beyond the overlaminate. As a result these outwardly extending folds are able to move independently of the overlaminate. Accordingly, when the ECL Label is rolled onto a cylindrical container, the free folds can be pressed flat.

Figure 2B:
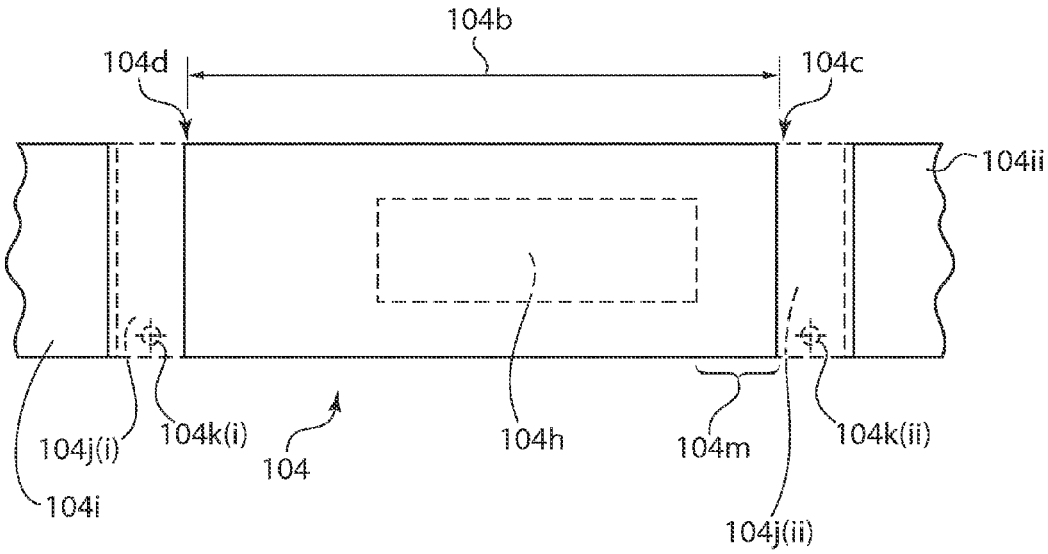

An alternate substrate is shown in FIG. 2B. Dimensionally, second substrate 104 includes a length 104*b*, a leading edge 104*c* and a trailing edge 104*d*. The adjacent substrates are shown in partial sections as substrates 104*i* and 104*ii*. In between the substrates 104 are waste panels 104*j*(i) (designated in dotted lines) and 104*j*(ii) bearing registration marks 104*k*(i) and 104*k*(ii). The registration mark 104*k* is used to align printing of indicia and adhesive onto the substrates 104. The waste panels 104*j* are then die cut and removed from the web as part of a waste matrix that extends around the substrates. As an alternate embodiment, second substrate 104 includes leaflet section 104*h* and a leading edge extension 104*m*. The leading edge extension 104*m* results in the leading edge 104*c* being spaced from leaflet section 104*h*.

After the folded leaflet 300 is adhered to second substrate 104, overlaminate 500 is applied to form a second ECL Label 101. Sections of overlaminate 500 are trimmed off so that the remaining overlaminate has a length about the same as the second substrate 101. The overlaminate tab 500*t* now adheres to leading edge extension 104*m*. Overlaminate tab 500*t*(i) can be removed and re-adhered to second substrate 104, which would provide a more uniform adhesion surface than a cylindrical container made of unknown material.

Figure 3C:
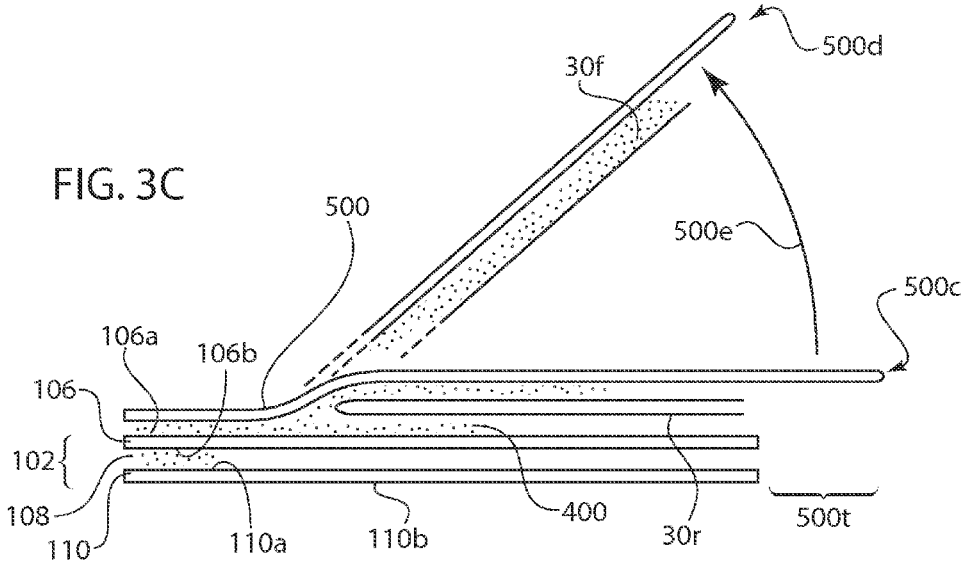
FIG. 3C is a bottom plan view of an ECL Label.

FIG. 3C shows a bottom plan view of the ECL Label 100 of FIG. 3A. When substrate 102 comprises label stock, a conventional web having facestock 106 adhered with adhesive 108 to a release liner 110. Facestock 106 has a top surface 106*a* and a bottom surface 106*b*. Top surface 106*a* has various structural features as shown in FIG. 2A. Adhesive 400 will be printed to top surface 106*a*, folded leaflets 300 will be attached to the adhesive and overlaminate 500 will be applied to top surface. Bottom surface 106*b* is coated with adhesive to adhere it to release liner. Die cutting will remove sections of facestock 106 and adhesive 108 leaving release liner intact. Release liner includes an upper surface 110*a* and a lower surface 110*b*.

In use, ECL Label 100 will be peeled off release liner 110 and release liner will be disposed of or recycled. Facestock 106 will be adhered to a cylindrical container. Overlaminate tab 500*t* will hold the folded leaflet closed with its overlaminate tab 500*t* removably adhered to the container. A closed state 500*c* of the overlaminate has overlaminate tab adhered to the container. In an open state 500*d*, overlaminate is peeled away in direction 500*e* carrying front portion 30*f* with rear portion 30*r* remaining adhered to facestock 106.

As mentioned earlier, overlaminate has a width 500*w* that is narrower than the leaflet width 12*w*. As can been seen in FIG. 3B, the folded leaflet 300 will possess an upper crush zone 330*c*, a lower crush zone 300*d*, or both. As will be appreciated, upper crush zone 300*c* includes all the upper accordion-type folds 16. It will also include the upper portions of the perpendicular fold(s) 26, that is portions of perpendicular fold(s) 26 that intersect the upper accordion-type folds 16. Lower crush zone 300*d* includes all the lower accordion-type folds 16. It will also include the lower portions of the perpendicular fold(s) 26, that is portions of perpendicular fold(s) 26 that intersect the lower accordion-type folds 16. When ECL Label 100 is placed onto container 700 a roller 600 moving in direction 600*a* will crush the folded leaflets to conform it to the radius of the container. The exposed folds in the crush zones 300*c* and 300*d* will be deformed and crushed as the panels fan out. By limiting adhesive section 102*g* to a minor portion of rear portion 30*r*, and limiting the width of overlaminate, and omitting glue within the folded leaflet; the majority of the panels and folds are free to move independently of the substrate and overlaminate. This independent movement of panels in combination with crushing the folds provides a thinner ECL Label at any radius.

In addition, the accordion folds allow air to escape from within the folded leaflets as the roller presses the ECL label onto its container. As can be seen in FIGS. 1B, 1C and 1D, each accordion fold 16 forms a V shape of two adjacent panels. Air which may be entrapped between any two panels can be flushed out through the open end of the V, that is, the side opposite the accordion fold. So for an accordion fold along the top, air can escape from the bottom of the folded leaflet. Correspondingly, for an accordion fold along the bottom, air can escape from the top of the folded leaflet. As can be seen in FIGS. 1F and 1G, this accordion fold venting can still occur if the leaflet has two or more perpendicular fold. While the perpendicular folds may limit venting in the longitudinal "X" direction, each panel section can always vent through the top or bottom, opposite the accordion fold.

In a practical embodiment, the label width 102*e* is 44 mm, the accordion folded sheet has a width 12*w* of 32 mm and the overlaminate width 500*w* is 26 mm.

Structurally, the ECL Label 100, 101 has an accordion folded sheet with a width 12*w* that is 60 to 90% of the label width 102*e*, preferably 65 to 80% of the label width and more preferably 73% of the label width.

Structurally, the ECL Label 100, 101 has an overlaminate width 500*w* that is 70 to 90% of the accordion folded sheet width 12*w*, preferably 75 to 85% of the sheet width and more preferably 81% of the sheet width.

Structurally, the ECL Label 100, 101 has an overlaminate width 500*w* that is 40 to 80% of the label width 102*e*, preferably 50 to 70% of the label width and more preferably 60% of the label width.

Figure 4A:
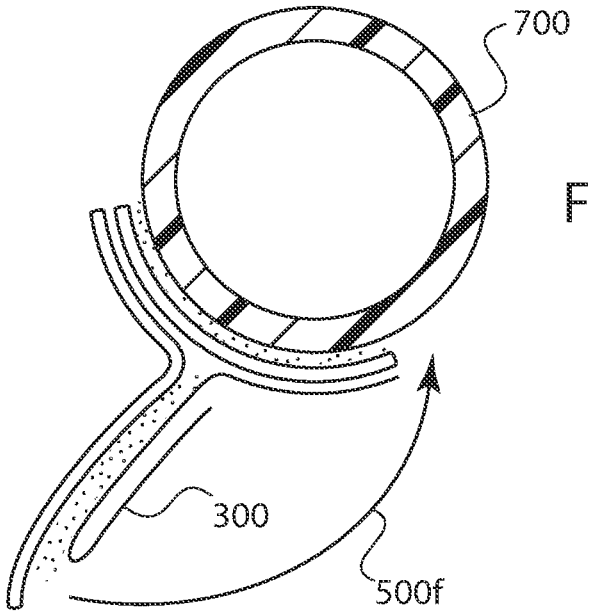
FIGS. 4A and 4B are perspective views of ECL Labels adhered to containers.
Figure 4B:
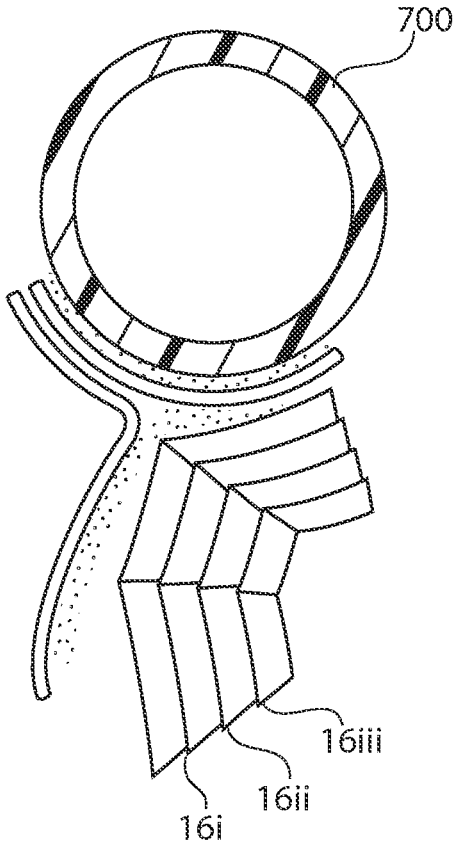

FIGS. 4A and 4B show ECL Label 100 adhered to a container 700. Overlaminate tab 500*t* can pivot in the direction of arrow 500*f* to the closed state 500*c* to close the folded leaflet 300. Overlaminate tab 500*t* can pivot in the direction of arrow 500*e* to the open state 500*d* to open the folded leaflet 300. In the open state, the perpendicular folds 26 are unfolded, returning the leaflet to the flat configuration of accordion folded sheet 20. The accordion folded sheet can unfold the accordion-type folds 16 to return to the open configuration of sheet 10. Compared to other leaflet configurations, it is obvious and apparent how to re-fold the expanded sheet. The bottom panel is folded above or under the panel above it. This step is repeated until the sheet is one panel wide and even with the label. Additional portions can be tucked in and the overlaminate pivoted back to its closed state.

While various forms of leaflets have been shown and described, it should be understood that additional configurations may be provided within the scope of the application. For example, leaflets with a greater number of panels and accordion and perpendicular folds may be provided. The leaflets can be aligned to or spaced from the leading edge of the substrate. The overlaminate may align to the leading and/or trailing edge of the substrate. The overlaminate may overhang the leading and/or trailing edge of the substrate.

Having described preferred embodiments for leaflets, panels, folds and labels (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An extended content label with a narrow overlaminate comprising:

a substrate having an upper surface;

a leaflet adhered to a section of said upper surface of said substrate and having (i) a plurality of overlying panels, (ii) longitudinally-extended accordion-type folds alternating along a top side and a bottom side of each panel, and (ii) one perpendicular fold oriented normal to the longitudinal direction and free ends opposite said one perpendicular fold; and an overlaminate strip that is laminated across the entire longitudinal direction of the leaflet and said free ends and laminated to another section of the upper surface of said substrate to form an extended content label, wherein the height of said overlaminate strip is narrower than the leaflet so that all of the accordion-type folds extend beyond the overlaminate strip.

2. The label of claim 1, wherein said leaflet consists of a single sheet that is devoid of glue in its interior.

3. The label of claim 1, wherein said perpendicular fold divides said leaflet into (a) a rear portion which is disposed adjacent said label; and (b) a front portion which is disposed adjacent said overlaminate strip.

4. The label of claim 3, wherein a first outer panel section of said rear portion is at least partially adhered to said upper surface.

5. The label of claim 4, wherein only a portion of one accordion-type fold adjacent said first outer panel section of the rear portion is constrained by adhesive whereby the remaining accordion-type folds are free to independently conform to various radii.

6. The label of claim 4, wherein a second outer panel section of said front portion is partially covered by said overlaminate strip.

7. The label of claim 6, wherein an end panel of said overlying panels includes said first outer panel section and said second outer panel section.

8. The label of claim 7, wherein said overlaminate strip includes two positions comprising:

a closed position in which the leaflet is pressed flat against said label, and an open position in which the leaflet is unfolded along said one perpendicular fold, wherein said overlaminate strip pivots between said closed position and said open position along a hinge located adjacent and parallel to said perpendicular fold.

9. The label of claim 7, wherein in said closed position said overlaminate strip extends beyond said free ends to a location co-planar with an end of said label.

10. The label of claim 8, wherein in said open position said overlying panels are generally straight and flat allowing said leaflet to unfold and fold along said accordion-type folds.

11. The label of claim 3, wherein said leaflet consists of a single sheet that is devoid of glue in its interior.

12. The label of claim 11, wherein said overlaminate strip includes two positions comprising:

a closed position in which the leaflet is pressed flat against said label, and an open position in which the leaflet is unfolded along said one perpendicular fold, wherein said overlaminate strip pivots between said closed position and said open position along a hinge located adjacent and parallel to said perpendicular fold.

13. The label of claim 12, wherein in said open position said rear portion and said front portion are angularly spaced from each other allowing at least one interior portion to unfold so that the overlying panels are generally straight and flat allowing said leaflet to unfold and fold along said accordion-type folds.

14. The label of claim 1, wherein said substrate comprises a facestock having a bottom surface coated with adhesive.

15. The label of claim 14, further including a release liner, wherein said adhesive temporarily secures said facestock to said release liner.

16. The label of claim 1, wherein said substrate includes a first edge and a second edge, wherein said perpendicular fold is disposed parallel to and spaced from said first edge.

17. The label of claim 16, wherein said free ends are disposed parallel to and co-linear with said second edge of said substrate.

18. The label of claim 1, further comprising a crush zone including said longitudinally extending accordion type folds and at least about 5% of the leaflet area adjacent said longitudinally extending accordion type folds.

19. The label of claim 18, wherein all of said longitudinally extending accordion type folds within the crush zone remain free from being adhered to said substrate and remain free from being adhered to said overlaminate strip.

20. The label of claim 19, wherein each of said longitudinally extending accordion type folds within said crush zone has a degree of freedom for radius conformity independently of said substrate and said overlaminate.

21. The label of claim 1, wherein said longitudinally-extended accordion-type folds alternating along a top side and a bottom side of each panel provide an air vent for each adjacent pair of panels on the bottom side and top side respectively.

* * * * *